US005105506A

United States Patent [19]

Lin

[11] Patent Number: 5,105,506

[45] Date of Patent: Apr. 21, 1992

[54] QUICK RELEASE HINGE WITH RESILIENT LATCH

[76] Inventor: Tsong C. Lin, No. 146 Min Chuen Rd., Ta Hu Tsun, Hu Nei Shiang, Kaohsiung Hsien, Taiwan

[21] Appl. No.: 641,715

[22] Filed: Jan. 15, 1991

[51] Int. Cl.[5] ..... E05D 7/10

[52] U.S. Cl. ..... 16/258; 16/DIG. 43

[58] Field of Search ..... 16/258, DIG. 43

[56] References Cited

U.S. PATENT DOCUMENTS

| | | | |
|---|---|---|---|
| 4,760,623 | 8/1988 | Toyama | 16/258 |
| 4,847,948 | 7/1989 | Gross et al. | 16/DIG. 43 |
| 4,850,080 | 7/1989 | Rock et al. | 16/258 |

*Primary Examiner*—Robert L. Spruill

*Assistant Examiner*—Carmine Cuda

*Attorney, Agent, or Firm*—Fleit, Jacobson, Cohn, Price, Holman & Stern

[57] ABSTRACT

A quick release furniture hinge has a pivot arm for attachment to one hinged part of a furniture article and a base plate for connection to another hinged part of the furniture article. A connecting plate assembly releasably attaches the pivot arm to the base plate by hooks at one end of the assembly which engage stub shafts on the base plate, and a pivoting latch at the other end of the assembly which latches over a projection on the base plate. The connecting plate assembly also has a pivoted toggle element for engaging and releasing the latch to allow separation of the connecting plate assembly and pivot arm from the base plate.

3 Claims, 3 Drawing Sheets

QUICK RELEASE HINGE WITH RESILIENT LATCH

BACKGROUND OF THE INVENTION

A hinge structure is disclosed in U.S. Pat. No. 4,837,894 titled "Spring Biased Arm Snap-Toggle Hinge" which comprises a base plate 1, a connecting plate 3, a first pivot arm 4, a second pivot arm 5, a third pivot arm 6, a fourth pivot arm 7, and a toggle segment 8 to form a snap-toggle hinge which can turn pivotally. The hinge has a base plate 1 for fixing the hinge on the door of a furniture article and a setting plate 2 for fixing on the side wall of the furniture article. The hinge connects to the setting plate 2 by means of bolts 224 and 225. Hence, screwdrivers are needed to unscrew bolts 224, 225 or 215 when the door and the side wall of furniture articles are to be separated. Two hinges are needed for mounting on each door and unscrewing of the bolts is not easy, and an operator can get hurt because the doors may be heavy and drop suddenly when being unscrewed.

SUMMARY OF THE INVENTION

The purpose of this invention is to improve the means for assembling the hinge. The hinges mounting the door on the side wall of a furniture item should be capable of being installed and separated rapidly so that the problems of operators getting hurt or a door falling down suddenly will be reduced.

Thus, a hinge according to the invention comprises a base plate, a connecting plate and a pivot arm. The connecting plate and the pivot arm are united to be fixed on the door of a furniture article. The base plate is to be fixed on the side wall of the furniture article. The base plate has a pair of protruding shafts to engage hooks on the connecting plate. The connecting plate uses the lip of a pivotal retaining plate to latch and unlatch from the bottom of a projection on the base plate.

BRIEF DESCRIPTION OF THE DRAWINGS

An embodiment of the invention will now be described by way of example and with reference to the accompanying drawings, in which.

DETAILED DESCRIPTION OF THE INVENTION

Figure 1:
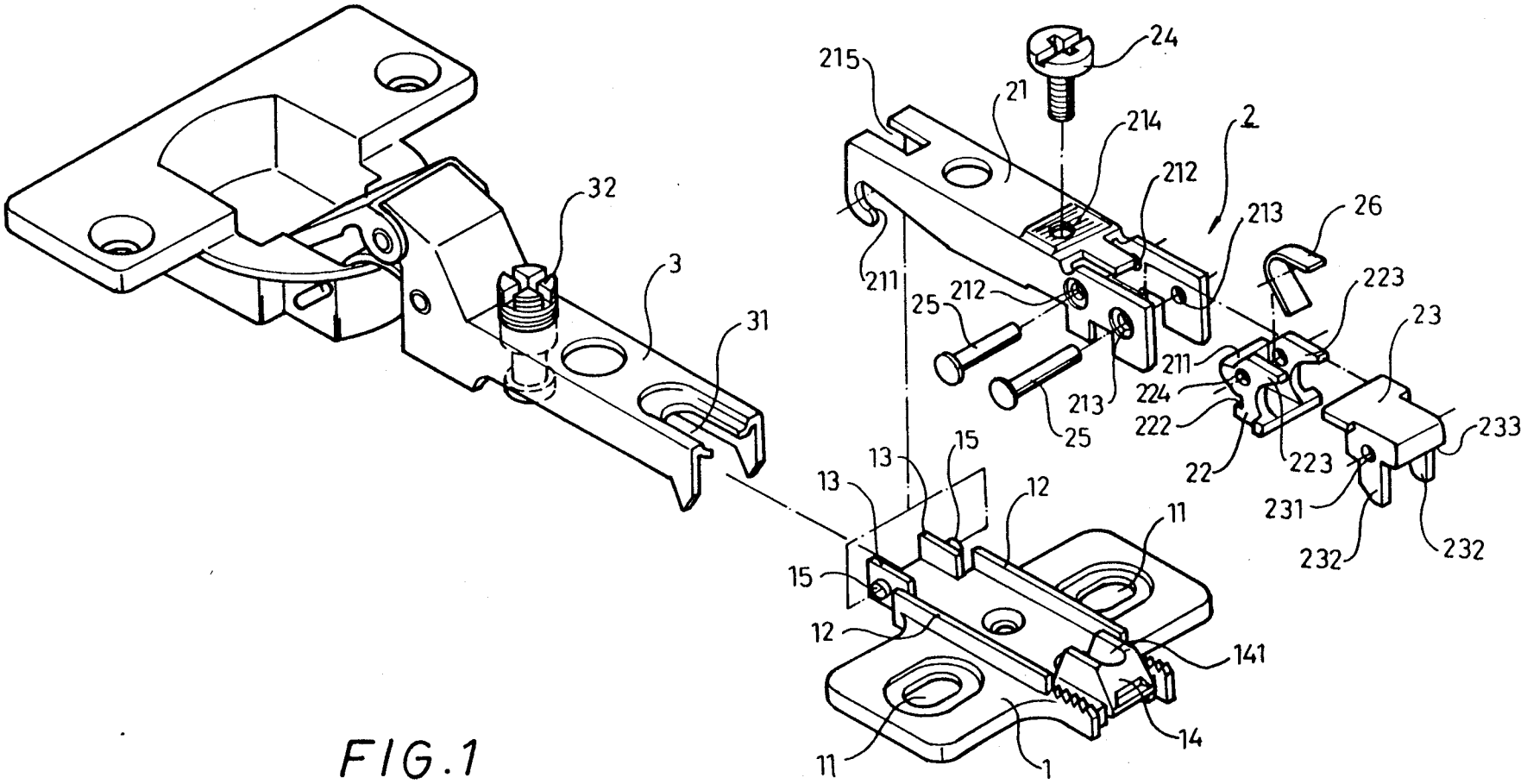
FIG. 1 is an exploded perspective view of a hinge in accordance with the invention.
Figure 2:
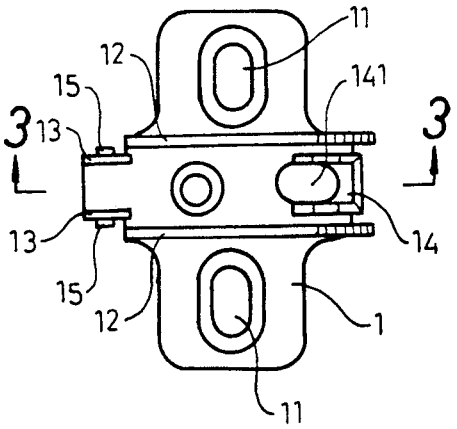
FIG. 2 is a plan view of a base plate of the hinge.
Figure 4:
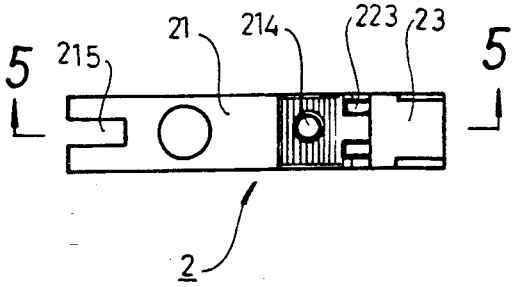
FIG. 4 is a plan view of a connecting plate of the hinge.
Figure 3:
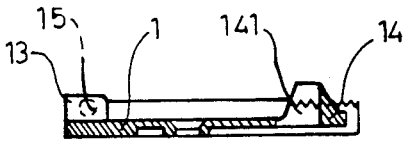
FIG. 3 is a sectional view on line 3—3 of FIG. 2.
Figure 5:
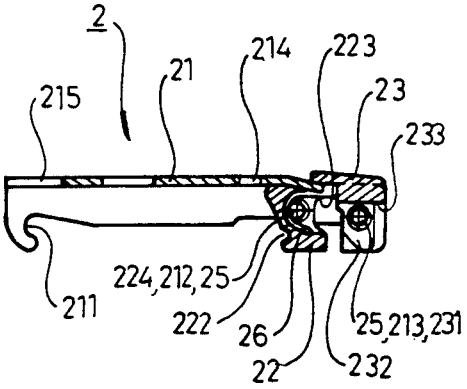
FIG. 5 is a sectional view on line 5—5 of FIG. 4.

Referring firstly to FIG. 1, a hinge in accordance with the invention comprises a base plate 1, a connecting plate assembly 2 and a pivot arm 3.

The base plate 1 is to be fixed on the side wall of a furniture article and is provided with two oval holes 11 for bolts to fix therein. The base plate 1 has two parallel tracks 12 to contain the connecting plate 2 therebetween. The upper rim of the tracks 12 and the lower rim of the pivot arm 3 have the same width. Inside one end of the tracks 12 are two narrower tracks 13 and at the opposite end of tracks 13 is a projection 14. The narrow tracks 13 have respective protruding stub shafts 15 to engage hooks 211 on the connecting plate 2 assembly. The projection 14 is for a retaining plate 22 on the connecting plate assembly 2 to engage with, and an aperture 141 in projection 14 is for bolt 24 in the connecting plate assembly 2 to insert through.

The connecting plate assembly 2 comprises a channel-shaped body 21, the retaining plate 22, and a toggle segment 23. The retaining plate 22 and the toggle segment 23 are pivotally connected with the body 21 by means of pins 25 inserted through shaft holes 212 and 213, in opposite sidewalls of the body. The hooks 211 to engage the shafts 15 on the base plate 1 are formed on the side walls of the body. A bolt hole 214 is provided in the top wall of the body for screw bolt 24, the head of which engages an open slot 31 of pivot arm 3.

The retaining plate 22 is pitovally connected to the body 21 by means of pins 25 inserted through shaft holes 224 and 212. A spring 26 inserted between the retaining plate 22 and the body 21 keeps a lip 211 of retaining plate 22 engaging a flange 212 of body 21. A protruded lip 222 at the bottom of retaining plate 22 is to engage the base of protrusion 14 in base plate 1. The retaining plate 22 also has two wings 223 extending rearwardly.

The toggle segment 23 is pivotally connected with the body 21 by means of pins 25 inserted through shaft holes 231 and 213. Two legs 232 of the toggle segment 23 can be rotated to engage the lower ends of wings 223 to turn the retaining plate 22 so that the protruded lip 222 of the retaining plate 22 is released from the bottom of projection 14 in the base plate 1. The movement of toggle segment 23 to release the retaining plate 22 is only 10 degrees until a stop edge 233 on the toggle plate engages the bottom of retaining plate 22, as shown in FIGS. 7 and 8.

Figure 6:
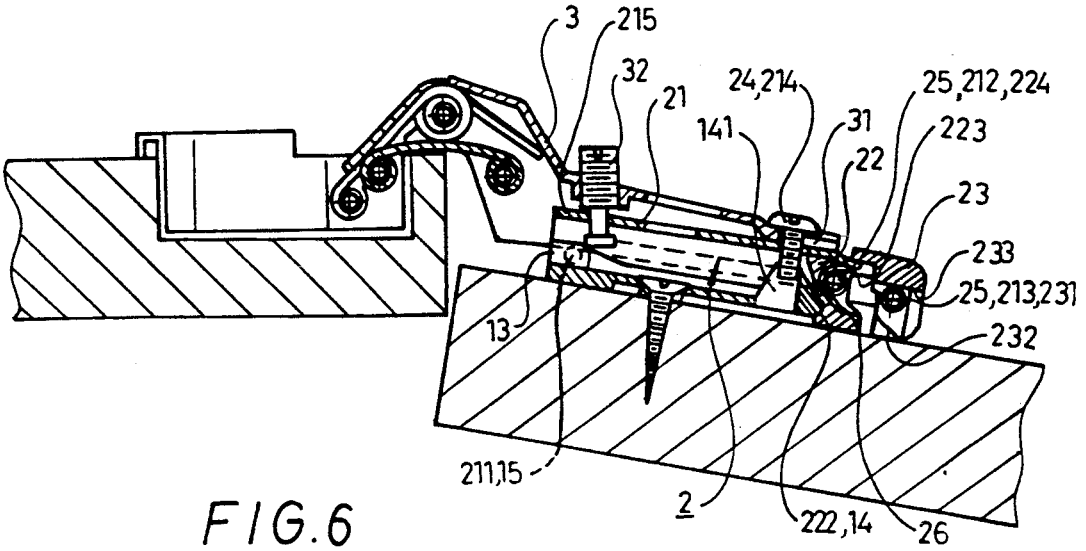
FIG. 6 is a sectional elevation of the hinge in an open position.

Referring to FIG. 6, the base plate 1 and the pivot arm 3 are fixed on the side wall and the door of a furniture article, respectively. The connecting plate assembly 2 is attached to the pivot arm 3 by a slot 215 in the end of body 21 engaging a recessed portion of bolt 32 in the pivot arm 3 and by the bolt 24 screwed through hole 214 into the open slot 31 in the pivot arm 3. The hooks 211 of the connecting plate assembly 2 are engaged with the shafts 15 of base plate 1 and the retaining plate 22 presses against the projection 14, with the lip 222 of retaining plate 22 locking under the bottom of projection 14 so as to fix the hinge on the door and the side wall of the furniture article.

Figure 7:
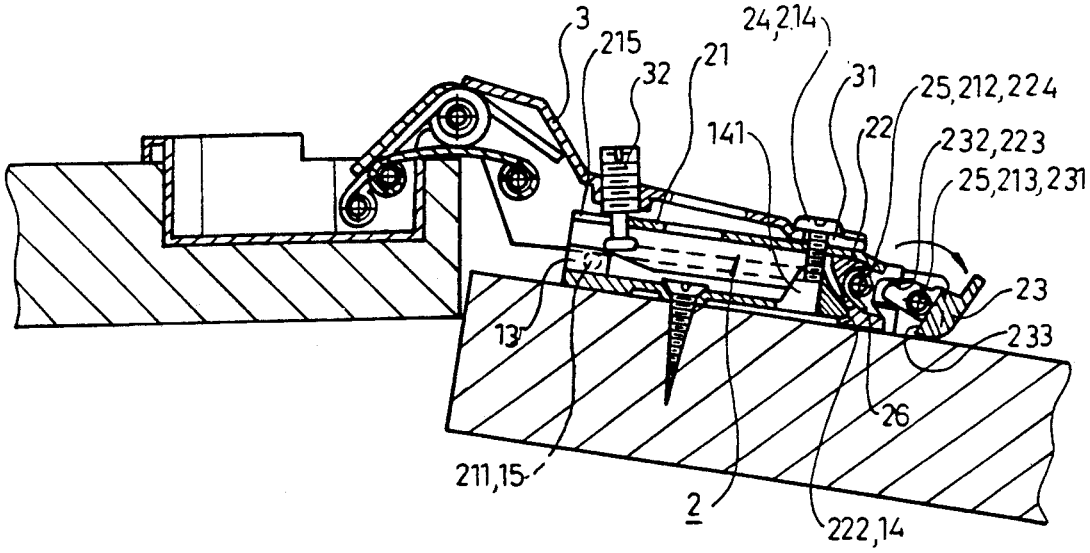
FIG. 7 is a sectional elevation of the hinge showing a separating movement.
Figure 8:
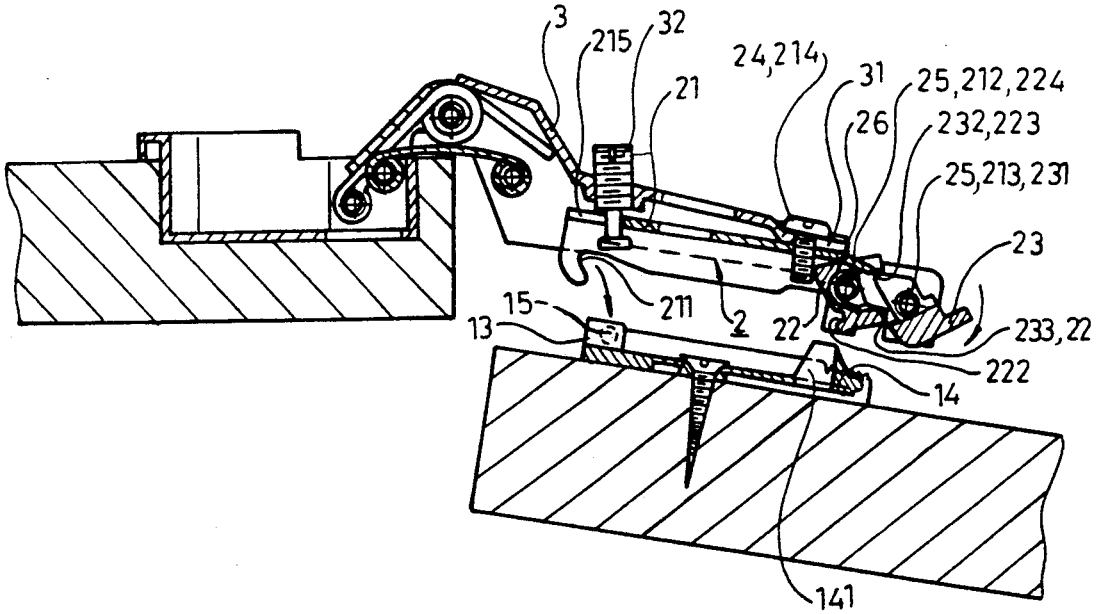
FIG. 8 is a sectional elevation of the hinge in a separated position.

Referring to FIG. 7, for separating the door from the side wall, the toggle segment 23 is turned clockwise as indicated by the arrow. The legs 232 of toggle segment 23 press the wings 223 of the retaining plate 22 upwardly so that the retaining plate 22 pivots on pins 25 counterclockwise about 10 degrees and the lip 222 of the retaining plate 22 separates from the bottom of projection 14. Hence, the hooks 211 of the connecting plate assembly 2 can be separated from the shafts 15 to provide separation of the door and the side wall, as shown in FIG. 8.

The structure in accordance with the invention facilitates installation and separation of the door and the side wall of a furniture article. Hence, the installation is easier, and the problem of the door falling suddenly during the separating process is diminished.

What is claimed is:

1. A quick release hinge for attaching a door of a furniture article to a side wall of the article comprising a base plate for connection to one of said door and wall, an elongate pivot arm for connection to the other of said door and wall, and a connecting plate assembly for releasable attachment between the base plate and the pivot arm, the base plate including an elongate track, a pair of walls at one end of said track with respective projecting stub shafts, and a projection at an opposite end of said track with an exposed bottom surface, the connecting plate assembly comprising an elongate channel-shaped body, connection means for attaching the body to the pivot arm, hooks at one end of the body for engaging over said stub shafts on the base plate, a retaining plate pivotally connected to the body adjacent an opposite end of the body, the retaining plate having a lip for engaging under said bottom surface of the projection on the base plate to latch the connecting plate assembly to the base plate when the hooks are engaged over said stub shafts, biasing means between the body and said retaining plate urging the lip to engage under said bottom surface, outwardly extending wing means on the retaining plate, a toggle segment pivotally connected to the body at said opposite end of the body in lengthwise adjacent relation to the connecting plate, the toggle segment having leg means for engaging the wing means on the retaining plate when the toggle segment is pivoted in one direction and thereby pivoting the retaining plate in the opposite direction against the action of the biasing means so as to disengage said lip from under the bottom surface of the projection on the base plate and allow the connecting plate assembly to be unlatched from the base plate.

2. A hinge as defined in claim 1, wherein the toggle segment includes a stop edge for engaging under a part of the retaining plate when the toggle segment is pivoted in said one direction and holding the retaining plate in an unlatched position.

3. A hinge as claimed in claim 1, wherein the connection means comprises a slot at said one end of the body for engaging a shank of a bolt on the pivot arm and a further bolt extending through a hole in said body into a further slot in the pivot arm.

* * * * *